United States Patent [19]

Marten

[11] Patent Number: 4,845,140

[45] Date of Patent: Jul. 4, 1989

[54] WAXLESS POLYVINYL ALCOHOL SIZE COMPOSITION

[75] Inventor: Finn L. Marten, Macungie, Pa.

[73] Assignee: Air Products and Chemicals, Inc., Allentown, Pa.

[21] Appl. No.: 167,214

[22] Filed: Mar. 11, 1988

Related U.S. Application Data

[63] Continuation of Ser. No. 882,760, Jun. 7, 1986, abandoned.

[51] Int. Cl.[4] ..... C08K 5/06; D06B 1/00; D06B 1/10

[52] U.S. Cl. ..... 524/245; 524/377; 524/557; 8/115.6; 252/8—8; 252/8-9

[58] Field of Search ..... 524/245, 377, 557; 8/115.6; 252/8.9, 8.8

[56] References Cited

U.S. PATENT DOCUMENTS

| | | | |
|---|---|---|---|
| 3,634,295 | 1/1972 | Dunlap et al. | 260/29.6 |
| 3,635,827 | 1/1972 | Jakobi | 252/89 |
| 3,804,765 | 4/1974 | Hijiya et al. | 260/17.4 |
| 4,012,352 | 3/1977 | Deyrup | 260/29.6 |
| 4,119,604 | 10/1978 | Wysong | 428/220 |
| 4,222,922 | 9/1980 | Rees | 260/29.6 |
| 4,251,403 | 2/1981 | Rees | 260/17.4 |
| 4,309,510 | 1/1982 | Kleber | 525/6 |
| 4,383,063 | 5/1983 | Rees | 524/91 |
| 4,389,506 | 6/1983 | Hassall, Jr. | 524/377 |
| 4,399,245 | 8/1983 | Kleber et al. | 524/108 |
| 4,428,751 | 1/1984 | Via | 8/477 |
| 4,501,589 | 2/1985 | Oschatz | 8/495 |

FOREIGN PATENT DOCUMENTS

| | | |
|---|---|---|
| 0173528 | 3/1986 | European Pat. Off. . |
| 21887 | 7/1970 | Japan . |
| 46-35972 | 10/1971 | Japan . |
| 35972 | 10/1971 | Japan . |
| 47-45634 | 11/1972 | Japan . |
| 48-238838 | 3/1973 | Japan . |
| 712671 | 4/1971 | South Africa . |

OTHER PUBLICATIONS

"The Wonderful World of Pluronic Polyols"-1971 BASF Wyandotte Corp.

*Primary Examiner*—Melvyn I. Marquis
*Assistant Examiner*—David W. Woodward
*Attorney, Agent, or Firm*—Michael Leach; William F. Marsh; James C. Simmons

[57] ABSTRACT

An aqueous waxless size composition for textile yarn comprising in an aqueous solution (a) 100 parts polyvinyl alcohol and (b) 2-6 parts ethylene oxide-propylene oxide surfactant which has a surface tension less than 49 dynes/cm, preferably between about 40 to 48 dynes/cm, as a 0.1% aqueous solution at 25° C., and desirably a foaming number less than about 20 (ml foam/g solution)°F. as a 7% aqueous polyvinyl alcohol solution containing 4 parts surfactant per 100 parts polyvinyl alcohol.

15 Claims, No Drawings

WAXLESS POLYVINYL ALCOHOL SIZE COMPOSITION

This a continuation, of application Ser. No. 06/882,760 filed July, 07 1986, now abandoned.

TECHNICAL FIELD

The invention relates to sizing textile yarn with aqueous polyvinyl alcohol compositions.

BACKGROUND OF THE INVENTION

Sizing of textile fibers with polyvinyl alcohol (PVOH) is well known in the art. PVOH with a degree of hydrolysis in the range of 87 to 100 mole % has proven effective in practice as a sizing agent.

Essentially all textile warp size compositions for spun yarns contain a hydrophobic waxy material, such as hydrogenated tallow wax in order to impart lubricity during weaving and to lessen both sticking to the drying cans and build-up during slashing.

In addition, such waxes are difficult to remove from the woven product prior to finishing. Special solvent extraction steps are sometimes used or finishing mills must accept a high percentage of second quality. Frequently wax spots left on the cloth result in dye defects.

Moreover, finishing mills are interested in lowering the temperature of the aqueous size removal systems which causes further removal problems with wax.

Further, foaming problems during sizing are observed whenever the degree of hydrolysis of the polyvinyl alcohol is below 99% and such problems increase with decreasing hydrolysis level. The presence of foam leads to uneven sizing with the result being a decrease in weaving efficiency. Foaming can be eliminated through the use of superhydrolyzed PVOH (degree of hydrolysis 99–100%) or by the use of defoamers.

The use of superhydrolyzed PVOH in sizing operations, however, imparts other problems such as brittleness of the sizing film which in turn leads to excessive shedding and reduced weaving efficiency. The film properties and adhesion to the fibers can be increased through the addition of polyacrylates, polyesters, polyglycerols and the like.

The film properties and the adhesion to the fibers of partially hydrolyzed PVOH (hydrolysis 85–96 mole %) are superior to those exhibited by superhydrolyzed PVOH. Further, the desizing can be accomplished at a lower temperature, due to decreased crystallinity of the PVOH, leading to an energy savings. Foaming during the sizing operation, however, has to a great extent prevented partially hydrolyzed PVOH grades from penetrating the sizing market despite the above advantages.

The foaming of aqueous sizing compositions containing partially hydrolyzed PVOH can, in many operations, be successfully overcome through the addition of defoamers such as Colloid 694, 693 or 513, Drew Y-281, Nopco NXZ L, Foammaster VL defoamers or certain ethylene oxide-propylene oxide adducts with a high level of propylene oxide. However, the presence of a hydrophobic waxy material in the typical aqueous sizing compositions will have a pronounced and detrimental effect on the performance of the above-mentioned defoamers. Thus, the foaming problem has, to a great extent, excluded PVOH products having a lower degree of hydrolysis from use in sizing compositions despite the mentioned advantages.

Japanese Patent Publication No. 47-45634 discloses a method for warp sizing polyamide synthetic fiber which comprises treating synthetic polyamide fiber with a warp-sizing composition comprising PVOH, a highly hydroscopic anionic surfactant and a nonionic surfactant which is lowfoaming polypropylene glycol-ethylene oxide adduct and/or monoester thereof. Example 1 (test 2) shows, in the absence of the anionic component, there is desizing in the weaving operation.

U.S. Pat. No. 4,389,506 discloses a process for the preparation of a substantially dust-free PVOH powder comprising contacting the PVOH with about 0.5 to 4% polyglycol. This document states that block copolymers containing the constituents of polyethylene glycol with propylene oxide in which the oxyethylene content predominates (more than 50%) are, to a lesser extent, suitable as long as the end-use properties of the PVOH are not adversely affected. Composition B in Example I shows PVOH plus 1% Pluronic F98 surfactant.

U.S. Pat. No. 4,428,751 discloses a process for the wet processing of textile materials which comprises applying to the textile material an aqueous textile-treating liquor containing a textile-treating component in an amount sufficient to provide a desired effect on the textile material, and further containing in an amount sufficient to provide foam control properties, a foam control agent of the formula

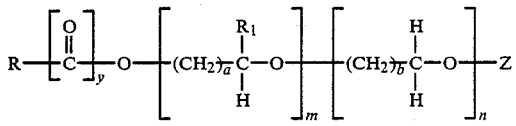

where y is 0 or 1; m and n are both independently an integer from 0 to 30 with the proviso that the sum of y+m+n must be at least 1; a and b are independently an integer from 1 to 7; R is a $C_1$-$C_{40}$ aliphatic group; $R_1$ is a $C_1$-$C_{16}$ alkyl group, a $C_1$-$C_7$ alkoxy group or a $C_3$-$C_8$ alkoxyalkyl group; and Z is hydrogen, halogen, phosphate or phosphite.

South African Patent 712671 discloses a jute sizing composition which comprises a dilute aqueous solution of PVOH which has been hydrolyzed to at least about 85% and a water soluble glycol selected from the group consisting of polyethylene glycol and polypropylene glycol.

U.S. Pat. No. 3,634,295 discloses a sizing composition for man-made yarns comprising a PVOH and a polyacrylic acid.

U.S. Pat. No. 3,804,785 discloses aqueous solutions of PVOH containing amylose and/or amylitol of low molecular weight for sizing paper and textile fibers.

U.S. Pat. No. 4,222,922 discloses a warp size for filament yarn consisting essentially of PVOH, alkylphenoxy (or cresoxy) ethoxyethyl dimethylbenzyl ammonium chloride and a plasticizer such as glycerol or urea.

U.S. Pat. No. 4,251,403 discloses a warp size for filament yarn consisting essentially of PVOH, urea and mono- and di-saccharides, such as sucrose.

U.S. Pat. No. 4,309,510 discloses a sizing composition consisting of a PVOH and 1–30 wt % of an amine oxide.

U.S. Pat. No. 4,383,063 discloses a PVOH based sizing solution containing a small amount of a quaternary (e.g., dialkyldimethyl) ammonium salt or quaternary imidazolinium salt additives.

U.S. Pat. No. 4,399,245 discloses a sizing composition consisting substantially of PVOH and polyglycerol.

SUMMARY OF THE INVENTION

The present invention provides a waxless sizing composition consisting essentially of (a) 100 parts PVOH, and (b) 2 to 6 parts ethylene oxide-propylene oxide surfactant having a surface tension less than about 49 dynes/cm at 25° C. in a 0.1% water solution. In a preferred embodiment the ethylene oxide-propylene oxide surfactant has a foaming number less than about 20 (ml foam °F./g solution) as a 7% aqueous PVOH solution containing 4 parts surfactant per 100 parts PVOH.

The sizing composition is utilized as an aqueous solution at about 2 to 20 wt %.

The addition of certain ethylene oxide-propylene oxide surfactants according to the invention to a PVOH sizing composition advantageously provides a waxless size that affords lubricity during weaving and easy release of the sized yarn from the drying drum as provided by wax-containing PVOH-size compositions, but also affords low shedding during the weaving operation, high weaving efficiency and, particularly, easy desizing. These advantages are obtained when the sizing composition is used for cotton-containing textile yarn. No significant advantages are observed for all polyester synthetic textile yarn.

The percentage decrease in hairiness resulting from the use of an ethylene oxide-propylene oxide surfactant in the PVOH size will depend upon the degree of hydrolysis and the molecular weight of the PVOH. The use of such surfactants according to the present invention at 4 wt % (based on PVOH) in an 8% aqueous PVOH sizing composition, the PVOH having about a 1700 degree of polymerization and being 87–90 mole % hydrolyzed, will provide at least about 55% decrease in hairiness compared to unsized 50/50 polyester/cotton spun yarn.

It is believed that the presence of the ethylene oxide-propylene oxide surfactant provides improved encapsulation and penetration of the yarns. Thus a size film having greater strength and lower shedding due to increased adhesion and uniformity is achieved. The hairiness of the yarn is often taken as a measure of these qualities. The improved adhesion is surprising in view of U.S. Pat. No. 3,598,883 which teaches that polyoxyethylene and polyoxymethylene may affect the adhesive ability of PVOH.

Another embodiment of the invention is a textile process for treating yarn which comprises passing the yarn through an aqueous size solution according to the invention, removing excess size solution from the yarn, drying the sized yarn, splitting the yarn, winding the yarn, weaving the yarn and removing the size from the woven product.

DETAILED DESCRIPTION OF THE INVENTION

According to the invention the sizing composition consists essentially of the following components:

(a) a PVOH which preferably is 85–99+ mole % hydrolyzed and has a viscosity ranging from about 3 to about 60 mPas (cps) as a 4% aqueous solution at 20° C., and (b) 2–6 wt % ethylene oxide-propylene oxide surfactant based on PVOH, the surfactant having a surface tension less than 49 dynes/cm and preferably between 40 and 48 dynes/cm measured at 25° C. in a 0.1% aqueous solution.

The sizing compositions according to the invention are waxless, i.e. the compositions do not contain a hydrophobic waxy material as is customary in the art, but provide the advantages of a wax-containing sizing composition. Furthermore, anionic surfactants are not needed.

Defoamers known to the art in the customary amounts may be added if foaming of the aqueous sizing compositions presents a problem. However, in a preferred embodiment certain ethylene oxide-propylene oxide surfactants which afford reduced foaming are used. Such ethylene oxide-propylene oxide surfactants have a foaming number less than about 20 (ml foam °F./g solution) as a 7% aqueous PVOH solution containing 4 parts surfactant per 100 parts PVOH.

Suitable polyvinyl alcohols for use in the sizing composition include fully hydrolyzed PVOH's (98–99+ mole % hydrolyzed) such as produced by methanolysis of polyvinyl acetate homopolymers, and copolymers of vinyl alcohol and methyl methacrylate at least 99.5 mole % hydrolyzed consisting of 94–98% vinyl alcohol and 2–6 wt % methyl methacrylate as disclosed in U.S. Pat. No. 3,689,469. Suitable partially hydrolyzed PVOH's are those that are about 85 to 97 mole % hydrolyzed although material which is at least about 78 mole % hydrolyzed may also be used. Partially hydrolyzed PVOH is preferred.

The ethylene oxide-propylene oxide surfactant is used preferably in an amount ranging from 3 to 5 wt %, and most desirably 3.5–4.5 wt %, based on polyvinyl alcohol. If less than about 2% ethylene oxide-propylene oxide surfactant is used, the percentage decrease in hairiness falls off dramatically, and at 1% or less sticking to the drying drum becomes a problem. At more than 6% ethylene oxide-propylene oxide surfactant the percentage decrease in hairiness starts to fall off and the integrity of the size film deteriorates because of the incompatibility of the two polymers.

Illustrative of suitable ethylene oxide-propylene oxide surfactants are those having the following formulas:

$$HO(C_2H_4O)_y(C_3H_6O)_x(C_2H_4O)_yH \qquad \text{I}$$

and $$\begin{array}{ccc} H(OC_2H_4)_y(OC_3H_6)_x & & (C_3H_6O)_x(C_2H_4O)_yH \\ & NCH_2CH_2N & \\ H(OC_2H_4)_y(OC_3H_6)_x & & (C_3H_6O)_x(C_2H_4O)_yH \end{array} \qquad \text{II}$$

where x and y are integers and are selected such that the oxypropylene groups constitute at least 900 molecular weight of the compound and the oxyethylene groups constitute 10 to 90 wt % of the compound. Surfactants according to the first formula are condensates of ethylene oxide with hydrophobic bases formed by condensing propylene oxide with propylene glycol. Such surfactants are sold commercially under the trademark Pluronic by BASF Wyandotte Corp. Surfactants according to the second formula are compounds formed by the addition of propylene oxide to ethylenediamine followed by the addition of ethylene oxide and are sold commercially under the trademark Tetronic by BASF Wyandotte Corp.

In addition, ethylene oxide-propylene oxide surfactants according to the above formulas in which the ethylene oxide and propylene oxide units are reversed have also been found suitable. Such reverse ethylene oxide-propylene oxide surfactants are also available from BASF Wyandotte Corp.

Monoesters of the above surfactants with $C_1$–$C_{18}$ carboxylic acids are contemplated as being functional, or operative, equivalents in this invention.

Ethylene oxide-propylene oxide surfactants having a surface tension less than 49 dynes/cm afford greater strength and lower shedding (reduced hairiness) when used in an aqueous PVOH-waxless composition. However, it is preferred to use such surfactants having a surface tension between about 40 and 48, especially 43 to 47, and further, those with a foaming number of less than 20, preferably less than 15 and most preferably below 10, because foam control is superior and defoamers may not needed.

The following technique is used to determine the foaming number, i.e. the degree of foaming of an aqueous size solution:

The aqueous size solution contains 7% PVOH (based on water) having a DP of about 1700 and a degree of hydrolysis of about 87–89 mole % and 4% ethylene oxide-propylene oxide (EO-PO) surfactant (based on PVOH).

The aqueous size solution (400 g) is placed in a 1 liter beaker, equilibrated at the desired temperature and stirred at 1000 rpm for one hour using a 2.25 inch 45° pitched turbine placed in the center of the beaker 0.75 inch below the liquid surface. The mixture is then transferred to a 1 liter graduated cylinder and the weight as well as volume of the foamed size is recorded. The foaming is calculated according to the following formulas:

$$\text{Foam Density (g/ml)} = \frac{\text{weight PVOH size solution (g)}}{\text{foam volume (ml)}}$$

$$\text{ml foam/g} = \frac{\text{(1-Foam Density)}}{\text{Foam Density}}$$

The foaming is measured at 140° F., 150° F., 170° F. and 190° F., thus covering the normal operating range of a sizing operation. When ml foam/g is plotted against temperature, the area below the curve from 140° to 190° F. is the foaming number, the measure of the foaming behavior of the size solution. The smaller the area, the lower the foaming number, and the lower the foaming tendency.

The PVOH-containing size composition of the present invention will be used as an aqueous solution in the textile industry. Thus an aqueous size solution will generally have a solids content from about 2 to about 20 wt %, preferably about 5 to 15 wt %, or 2 to 7 wt % if the yarn is double-dipped.

Any means and method for physically mixing the components in an aqueous medium can be used. Preferably the PVOH and the ethylene oxide-propylene oxide surfactant are simply added to the cooking kettle containing water (heated). The surfactant may be physically mixed with the PVOH or sprayed on the PVOH as a liquid or solution to yield a solids product for subsequent dissolving in water.

Starch is often blended with PVOH in sizing compositions. Similarly, the present size composition can also contain common textile warp size starch. The sizing composition can also be modified with other materials for specific textile uses as is customary in sizing applications.

The temperature of the aqueous size solution should be between 50° C. (122° F.) and 93° C. (200° F.) preferably between 60° C. (140° F.) and 88° C. (190° F.) in the sizing operation. Either single or multiple size boxes containing the aqueous size solution may be used as is well known in the art. After removal of excess size solution by passage between squeeze rolls, the sized yarn is dried by contact with multiple drying cans heated to a temperature of about 100° to 175° C., split by stationary lease rods, and wound as a weaving beam. The slashing operation is conducted at speeds of 10 to 100 meters/min.

Advantageous properties of the size composition include no build-up on drying cans, clean splitting at the lease bars without breakage of ends or filaments, easy separation of the sized yarns when entering into the loom harness, and reduced foaming in the size box when the preferred ethylene oxide-propylene oxide surfactants are used.

Weaving may be performed with conventional shuttle looms, air-jet looms, rapier looms or shuttleless weaving machines. Beneficial characteristics are production of first class cloth, loom efficiency, absence of loom fouling by shedding and very easy desizing. During finishing the size is removed by scouring with hot water. The size is easily removed especially in the case of partially hydrolyzed PVOH by using a moderate water temperature of 50° to 70° C. There is no need for a special solvent extraction step since there is no hard-to-remove wax in the sizing composition. Thus wax spots on the cloth resulting in dye defects are absent.

The use of PVOH/ethylene oxide-propylene oxide surfactant waxless size compositions according to the present invention for cotton-containing textile yarn affords surprisingly high weaving efficiency and decreased shedding during weaving. The weaving efficiency is essentially identical to that obtained using a conventional PVOH/tallow wax composition. Cotton-containing textile yarns include combinations of synthetic fibers such as, for example, polyesters and polyamides, with at least 10%, preferably at least 35% cotton fibers or all-cotton yarns.

The following examples are given for the purpose of illustrating the present invention. All parts and percentages are by weight unless otherwise specified.

The hairiness was measured using a Shirley Yarn Hairiness Meter/ Winder Model 4 connected to an Epson HX-20 computer. The total yarn length used in the measurements was 50 meters. The 50 meter sample was prepared by knotting together yarns of 1.5–2 meter length in order to obtain a representative sample of the sized warp.

The penetration and encapsulation data was obtained by embedding the sized yarns in Versamid 940 polyamide, preparing a microtome cross section of 11–12 microns thickness, treating this with a toluene/isopropanol mixture followed by exposure to an iodine solution. The prepared cross-section was then placed in a microscope in order to obtain a 35 mm picture by which the penetration and encapsulation was determined. The PVOH containing areas appeared as the dark colored areas.

EXAMPLE 1

This Example presents the foaming numbers which were determined for a number of ethylene oxide-propylene oxide (EO-PO) surfactants having a surface tension ranging from 33 to 50.4 dynes/cm following the previously described procedure.

Run 1 was a control using the aqueous waxless PVOH size composition without a surfactant. Runs 2–16 employed, in addition, an ethylene oxide-propylene oxide surfactant. The data is presented in Table I.

TABLE I

| EO-PO SURFACTANT | | | | | | | | FOAMING | |
|---|---|---|---|---|---|---|---|---|---|
| Run # | | Wt. % EO | Wt. % PO | HLB | MW grams/mole | Cloud Point °C. | Surface Tension dynes/cm | Dynamic Foam Ht. mm | Foaming Number (ml foam/gram) °F. |
| 1 | | — | — | — | — | — | — | — | 39.1 |
| 2 | P-17R1 | 10 | 90 | 2.5 | 1900 | 32 | 33.0 | 5 | 17.0 |
| 3 | P-L122 | 20 | 80 | 4.0 | 5000 | 19 | 33.0 | 15 | 36.8 |
| 4 | P-L92 | 20 | 80 | 5.5 | 3650 | 26 | 35.9 | 25 | 38.3 |
| 5 | P-25R2 | 20 | 80 | 3.5 | 3100 | 29 | 37.5 | <5 | 14.0 |
| 6 | P-31R2 | 20 | 80 | 2.9 | 3300 | 30 | 38.9 | <5 | 5.8 |
| 7 | P-25R4 | 40 | 60 | 6.0 | 3600 | 40 | 40.9 | 70 | 1.8 |
| 8 | P-L108 | 80 | 20 | 27.0 | 14000 | >100 | 41.2 | >600 | 40.8 |
| 9 | T-150R8 | 80 | 20 | 11.2 | 20400 | 38 | 44.4 | 50 | 15.3 |
| 10 | P-25R8 | 80 | 20 | 12.1 | 8550 | 45 | 46.1 | 50 | 17.0 |
| 11 | P-L42 | 20 | 80 | 8.0 | 1630 | 37 | 46.5 | 10 | 10.0 |
| 12 | T-110R7 | 70 | 30 | 9.5 | 13200 | 52 | 46.5 | 45 | 18.2 |
| 13 | P-L31 | 10 | 90 | 4.5 | 1100 | 37 | 46.9 | 18 | 3.5 |
| 14 | P-17R8 | 80 | 20 | 13.4 | 7000 | 81 | 47.3 | 45 | 25.4 |
| 15 | T-90R8 | 80 | 20 | 12.9 | 18700 | 81 | 50.4 | 30 | 31.0 |
| 16 | P-L61 | 10 | 90 | 3.0 | 2000 | 24 | —(1) | 10 | 10.5 |

P = Pluronic EO-PO surfactant
T = Tetronic EO-PO surfactant
(1)Not water soluble.

The data in Table 1 demonstrates the importance of surface tension and foaming number for achieving foam control. It can be seen that Runs 2, 5–7, 9–13 and 16 provided surprising foam control. Runs 3, 4, 8, 14 and 15 in which the surfactant had a foaming number greater than 20 demonstrated only slight, if any, foaming control.

EXAMPLE 2

Size solutions were prepared by slurrying 20.4 kg of WS-53 polyvinyl alcohol from Air Products and Chemicals, Inc. (degree of polymerization about 1700; degree of hydrolysis about 87–90 mole %) and 0.804 kg of ethylene oxide-propylene oxide surfactant into 183 kg of water. A solution was formed by injecting steam into the aqueous mixture under stirring until a temperature of 98° C. was reached. The final solution solids was measured once the mixture had been added to the size box. The size composition was applied to 50/50 polyester/cotton spun yarns having a yarn count of 24.5 using a conventional commercial slasher. The hairiness of the unsized yarn was 33.4 hairs/meter. The yarn speed during slashing was 12 yards per minute and the temperature in the size box was at 82° C. (180° F.).

The obtained sized yarn properties are shown in Table II. The results show that the EO-PO compound's surface tension has a great influence upon the hairiness. A % decrease in hairiness of less than 55% is not acceptable since it is not significant enough to reduce shedding and weaving inefficiency. Runs 20–26 showed an acceptable decrease in hairiness.

TABLE II

| EO-PO SURFACTANT | | | | | YARN PROPERTIES | | | | | | RUNNING CHARACTERISTICS | | |
|---|---|---|---|---|---|---|---|---|---|---|---|---|---|
| RUN | ADDITIVE | % EO | dynes/cm | Mw grams/mole | Add-on | % Penet. | Degrees Encaps. | Hairiness | % Decrease Hairiness | Normalized dec. to 10% Solids | Size(1) Solids % | Drier Build-up | Splitting(2) |
| 17 | P-10R5 | 50 | 50.9 | 1950 | 9.9 | 20 | 348 | 17.1 | 48.8 | 49.3 | 8.0 | No | 3 |
| 18 | T-90R8 | 80 | 50.4 | 18700 | 10.8 | 17 | 353 | 21.6 | 35.3 | 32.7 | 8.3 | No | 3 |
| 19 | P-F68 | 80 | 50.3 | 8400 | 10.9 | 18 | 343 | 15.3 | 54.2 | 49.7 | 8.0 | No | 3 |
| 20 | P-L31 | 10 | 46.9 | 1100 | 9.7 | 18 | 354 | 13.4 | 59.9 | 61.8 | 8.0 | No | 1 |
| 21 | P-25R8 | 80 | 46.0 | 8550 | 10.2 | 17 | 344 | 9.4 | 71.9 | 70.5 | — | No | 2 |
| 22 | T-150R8 | 80 | 44.4 | 20400 | 10.9 | 16 | 350 | 12.1 | 63.8 | 58.5 | 8.0 | No | 3 |
| 23 | T-90R4 | 40 | 42.7 | 7240 | 9.8 | 16 | 345 | 13.3 | 60.2 | 61.4 | 7.4 | No | 4 |
| 24 | P-F108 | 80 | 41.2 | 14600 | 11.0 | 17 | 347 | 12.0 | 64.1 | 58.3 | 8.0 | No | 2 |
| 25 | P-25R4 | 40 | 40.9 | 3600 | 10.5 | 18 | 324 | 14.1 | 57.8 | 55.0 | 8.3 | No | 2 |
| 26 | P-17R1 | 10 | 33.0 | 1900 | 10.0 | 19 | 344 | 14.3 | 57.2 | 57.2 | 8.1 | — | 4 |

(1)Solids measured in size box
(2)Splitting is classified from 1 through 4; 1 being easy and 4 very hard

EXAMPLE 3

Size solutions were prepared as described in Example 2 with the exception that the ethylene oxide-propylene oxide (EO-PO) surfactant content based on PVOH was varied from 2.0 wt % to 8.0 wt %. The EO-PO compound used was Pluronic 25R8 surfactant obtained from BASF Wyandotte. The results in Table III indicate that the optimum ratio of EO-PO surfactant to PVOH is between 0.025 and 0.07. Higher amounts of EO-PO block copolymers severely weaken the size film.

TABLE III

| EO-PO SURFACTANT | | | YARN PROPERTIES | | | | | | RUNNING CHARACTERISTICS | | |
|---|---|---|---|---|---|---|---|---|---|---|---|
| RUN | ADDITIVE | % on PVOH | Add-on | % Penet. | Degrees Encaps. | Hairiness | % Decrease Hairiness | Normalized dec. to 10% Solids | Size Solids % | Drier Build-up | Splitting |
| 27 | P-25R8 | 2.0 | 10.1 | 18 | 355 | 17.4 | 47.9 | 47.4 | 8.9 | No | 2 |
| 21 | P-25R8 | 4.0 | 10.2 | 17 | 344 | 9.4 | 71.9 | 70.5 | — | No | 2 |
| 28 | P-25R8 | 8.0 | 11.3 | 19 | 352 | 10.3 | 69.2 | 61.2 | 8.0 | No | 2 |

EXAMPLE 4

Size solutions were prepared by slurrying 26.5 kg of WS-42 polyvinyl alcohol from Air Products and Chemicals, Inc. (degree of polymerization about 900; degree of hydrolysis about 95–97 mole %) and 1.06 kg of an ethylene oxide-propylene oxide surfactant into 177 kg of water. A solution was formed by injecting steam into the aqueous mixture under stirring until a temperature of 98° C. was reached. The slashing conditions and yarn used were as described in Example 2. The obtained sized yarn properties shown in Table IV indicate that the maximum decrease in hairiness occurs if the surface tension of the EO-PO additive is maintained in the 40–48 dynes/cm range.

TABLE IV

| EO-PO SURFACTANT | | | | | YARN PROPERTIES | | | | | | RUNNING CHARACTERISTICS | | |
|---|---|---|---|---|---|---|---|---|---|---|---|---|---|
| RUN | ADDITIVE | % EO | dynes/cm | Mw grams/mole | Add-on | % Penet. | Degrees Encaps. | Hairiness | % Decrease Hairiness | Normalized dec. to 10% Solids | Size Solids % | Drier Build-up | Splitting |
| 29 | P-10R5 | 50 | 50.9 | 1950 | 12.4 | 17 | 351 | 21.9 | 34.4 | 27.7 | — | No | 2 |
| 30 | P-25R8 | 80 | 46.0 | 8550 | 14.5 | 17 | 353 | 8.1 | 75.7 | 52.2 | 10.5 | No | 2 |
| 31 | P-25R4 | 40 | 40.9 | 3600 | 13.7 | 16 | 348 | 11.1 | 66.8 | 48.8 | 10.0 | No | 1 |
| 32 | P-17R1 | 10 | 33.0 | 1900 | 15.4 | 15 | 347 | 14.2 | 57.5 | 37.3 | 10.2 | No | 4 |

EXAMPLE 5

Size solutions were prepared as described in Example 2 with the exception of the PVOH which in this case was VINOL 325 polyvinyl alcohol of Air Products and Chemicals, Inc. having a degree of polymerization of about 1700 and a degree of hydrolysis of 97.5–99 mole %. The data shown in Table V indicate that the decrease in hairiness is little influenced by the surface tension of the additive in the range investigated when a substantially fully hydrolyzed polyvinyl alcohol is used.

TABLE V

| EO-PO SURFACTANT | | | | | YARN PROPERTIES | | | | | | RUNNING CHARACTERISTICS | | |
|---|---|---|---|---|---|---|---|---|---|---|---|---|---|
| RUN | ADDITIVE | % EO | dynes/cm | Mw grams/mole | Add-on | % Penet. | Degrees Encaps. | Hairiness | % Decrease Hairiness | Normalized dec. to 10% Solids | Size Solids % | Drier Build-up | Splitting |
| 33 | P-10R5 | 50 | 50.9 | 1950 | 11.4 | 14 | 352 | 15.2 | 54.5 | 47.8 | 8.0 | No | 4 |
| 34 | P-25R8 | 80 | 46.0 | 8550 | 9.8 | 17 | 349 | 13.7 | 59.0 | 53.6 | 8.0 | No | 4 |
| 35 | P-25R4 | 40 | 40.9 | 3600 | 9.3 | 15 | 348 | 18.2 | 45.5 | 46.4 | 8.1 | No | 4 |
| 36 | P-17R1 | 10 | 33.0 | 1900 | 11.0 | 16 | 348 | 10.1 | 69.8 | 75.0 | 8.0 | No | 4 |

EXAMPLE 6

A size solution was prepared as described in Example 4. However, the PVOH used in this example was T-66 obtained from DuPont and believed to be a PVOH/-methyl methacrylate copolymer. The additive used was Pluronic 25R8 surfactant. The hairiness was within the uncertainty identical to that obtained whenever WS-42 polyvinyl alcohol was used as shown in Example 4.

TABLE VI

| EO-PO SURFACTANT | | | | | YARN PROPERTIES | | | | | | RUNNING CHARACTERISTICS | | |
|---|---|---|---|---|---|---|---|---|---|---|---|---|---|
| RUN | ADDITIVE | % EO | dynes/cm | Mw grams/mole | Add-on | % Penet. | Degrees Encaps. | Hairiness | % Decrease Hairiness | Normalized dec. to 10% Solids | Size Solids % | Drier Build-up | Splitting |
| 37 | P-25R8 | 80 | 46.0 | 8550 | 15.6 | 16 | 357 | 8.7 | 74 | 47.4 | 10.2 | No | 4 |

EXAMPLE 7

A size solution was prepared by slurrying 159 kg (350 lbs.) of PVOH (DP of 1700, degree of hydrolysis 87–89%), 6.4 kg (14 lbs.) of an ethylene oxide-propylene oxide adduct into 1325 kg of $H_2O$. A solution was formed by injecting steam into the size solution, under stirring until a temperature of 82° C. (180° F.) was reached. The final solution solids was 9%. This material was used to size a 65/35 polyester/cotton spun yarn employing a conventional slasher. The yarn speed was 86 yards/min., size box temperature 82° C. (180° F.) and squeeze roll pressure 15 psig. Weaving of the slashed yarn was accomplished using a Schulzer air jet loom. The obtained results are shown in Table VII.

TABLE VII

| ETHYLENE OXIDE-PROPYLENE OXIDE SURFACTANT | | | | | | | | WEAVING CHARACTERISTICS | | SIZED APPLICATION QUALITY | | | |
|---|---|---|---|---|---|---|---|---|---|---|---|---|---|
| RUN | ADDITIVE | % EO | % PO | HLB | MW grams/mole | Surface Tension dynes/cm | Foaming Number | Warp Stops 100000 picks Wt. % | Weaving Efficiency % | Size Add-on | % Penetration | Degrees Encapsulation | Hairiness hairs/meter |
| 38* | — | — | — | — | — | — | — | 0.8 | 93.5 | 9.7 | 22 | 342 | 17 |
| 39 | P-25R8 | 80 | 20 | 12.1 | 8550 | 46.1 | 17.0 | 0.6 | 95.1 | 9.8 | 22 | 347 | 18 |
| 40 | T-110R7 | 70 | 30 | 9.5 | 13200 | 46.5 | 18.2 | 0.8 | 95.2 | 9.4 | 26 | 339 | 14.4 |

*contained hydrogenated tallow wax

The results in Table VII compare the weaving efficiency and hairiness of traditionally sized warps where hydrogenated tallow wax was used to impart lubricity (Run 38), to those (Runs 39 and 40) obtained using a waxless formulation according to the invention. Table VII clearly indicates the obtained weaving efficiency imparted by the ethylene-propylene oxide adducts is essentially the same as that of the tallow wax. Such weaving efficiency when coupled with low foaming, lubricity and easier desizing in the absence of a wax is recognized by the industry as a significant improvement.

The ethylene oxide-propylene oxide surfactants which have a surface tension between about 40 and 48 dynes/cm and a foaming number less than about 20 prevent build-up on the drying cans by depositing a thin liquid film on the dryer drums thus prevent direct contact between the PVOH coated fibers and the can. In addition to the fact that the interfacial tension of the surfactant is lower than that of PVOH, the phase separation between PVOH and the surfactant leads to a deposit of surfactant on the surface of the fiber which provides lubricity. The surfactant, furthermore, works as a wetting agent promoting good penetration and complete encapsulation of the yarns, thus producing a size film having greater strength and lower shedding due to increased adhesion and uniformity. The size composition according to the invention takes advantage of the excellent size properties inherent to partially hydrolyzed polyvinyl alcohols, thus permitting the elimination of additives such as polyacrylates, polyesters, polyglycerols and the like as needed in the case of fully hydrolyzed polyvinyl alcohols.

STATEMENT OF INDUSTRIAL APPLICATION

The invention provides an aqueous waxless polyvinyl alcohol-containing size composition which affords a high weaving efficiency acceptable hairiness, very easy desizing when used in conjunction with cotton-containing textile yarn.

I claim:

1. A waxless, low foaming sizing composition consisting essentially of (in parts by weight)
   (a) 100 parts polyvinyl alcohol which is at least 78 mole % hydrolyzed and has a viscosity of about 3–60 cps as a 4% aqueous solution at 20° C., and
   (b) 2–6 parts ethylene oxide-propylene oxide surfactant having a surface tension less than 49 dynes/cm measured at 25° C. in an 0.1% aqueous solution and a foaming number less than about 20 as a 7% aqueous polyvinyl alcohol solution containing 4 parts surfactant per 100 parts polyvinyl alcohol having a DP of about 1700 and a degree of hydrolysis of about 87–89 mole %, the surfactant being represented by one of the following formulas:

$$HO(C_2H_4O)_y(C_3H_6O)_x(C_2H_4O)_yH \qquad \text{I}$$

or $$\begin{array}{ccc} H(OC_2H_4)_y(OC_3H_6)_x & & (C_3H_6O)_x(C_2H_4O)_yH \\ & NCH_2CH_2N & \\ H(OC_2H_4)_y(OC_3H_6)_x & & (C_3H_6O)_x(C_2H_4O)_yH \end{array} \qquad \text{II}$$

were x and y are integers and are selected such that the oxypropylene groups constitute at least 900 molecular weight of the surfactant and the oxyethylene groups constitute 10–90 wt % of the surfactant, or the above formulas in which the ethylene oxide and propylene oxide units are reversed.

2. The sizing composition of claim 1 in which the polyvinyl alcohol is 85–97 mole % hydrolyzed.

3. The sizing composition of claim 1 in which the surfactant has a surface tension between 40 and 48 dynes/cm.

4. The sizing composition of claim 1 in which the surfactant has a surface tension between 43 and 47 dynes/cm.

5. The sizing composition of claim 3 in which the surfactant has a foaming number less than 15.

6. The sizing composition of claim 3 in which the surfactant has a foaming number less than 10.

7. An aqueous sizing composition comprising from 2 to 20 wt % of the sizing composition of claim 1 in an aqueous medium.

8. A waxless low foaming sizing composition consisting essentially of (in parts by weight)
   (a) 100 parts polyvinyl alcohol which is at least 85 mole % hydrolyzed and has a viscosity of about 3–60 cps as a 4% aqueous solution at 20° C., and
   (b) 3–5 parts ethylene oxide-propylene oxide surfactant having a surface tension ranging from 40–48 dynes/cm measured at 25° C. in a 0.1% aqueous solution and a foaming number less than about 15 as a 7% aqueous polyvinyl alcohol solution containing 4 parts surfactant per 100 parts polyvinyl alcohol having a DP of about 1700 and a degree of hydrolysis of about 87–89 mole %, the surfactant being represented by one of the following formulas:

$$HO(C_2H_4O)_y(C_3H_6O)_x(C_2H_4O)_yH \qquad \text{I}$$

or $$\begin{array}{ccc} H(OC_2H_4)_y(OC_3H_6)_x & & (C_3H_6O)_x(C_2H_4O)_yH \\ & NCH_2CH_2N & \\ H(OC_2H_4)_y(OC_3H_6)_x & & (C_3H_6O)_x(C_2H_4O)_yH \end{array} \qquad \text{II}$$

where x and y are integers and are selected such that the oxypropylene groups constitute at least 900 molecular weight of the surfactant and the oxyethylene groups constitute 10–90 wt % of the surfactant, or the above formulas in which the ethylene oxide and propylene oxide units are reversed.

9. The sizing composition of claim 8 in which the polyvinyl alcohol is 85–97 mole % hydrolyzed.

10. The sizing composition of claim 8 in which the polyvinyl alcohol is 85–89 mole % hydrolyzed.

11. An aqueous sizing composition comprising from 2 to 20 wt % of the sizing composition of claim 8 in an aqueous medium.

12. The sizing composition of claim 8 in which the ethylene oxide-propylene oxide surfactant is about 40 wt % ethylene oxide, about 60 wt % propylene oxide and about 3600 molecular weight and has an HLB of about 6 and a surface tension of about 41 dynes/cm.

13. The sizing composition of claim 8 in which the ethylene oxide-propylene oxide surfactant is about 80 wt % ethylene oxide, about 20 wt % propylene oxide and about 8550 molecular weight and has an HLB of about 12 and a surface tension of about 46 dynes/cm.

14. A waxless, low foaming sizing composition consisting essentially of (in parts by weight)

(a) 100 parts polyvinyl alcohol which is 87–89 mole % hydrolyzed and has a viscosity of about 3–60 cps in a 4% aqueous solution at 20° C., and (b) 3.5–4.5 parts ethylene oxide-propylene oxide surfactant having a surface tension ranging from 40–48 dynes/cm measured at 25° C. in a 0.1% aqueous solution and a foaming number less than about 20 as a 7% aqueous polyvinyl alcohol solution containing 4 parts surfactant per 100 parts polyvinyl alcohol having a DP of about 1700 and a degree of hydrolysis of about 87–89 mole %, the surfactant being represented by one of the following formulas:

$$HO(C_2H_4O)_y(C_3H_6O)_x(C_2H_4O)_yH \qquad \text{I}$$

or $$\begin{array}{ccc} H(OC_2H_4)_y(OC_3H_6)_x & & (C_3H_6O)_x(C_2H_4O)_yH \\ & \diagdown\ \diagup\ NCH_2CH_2N\ \diagdown\ \diagup & \\ H(OC_2H_4)_y(OC_3H_6)_x & & (C_3H_6O)_x(C_2H_4O)_yH \end{array} \qquad \text{II}$$

where x and y are integers and are selected such that the oxypropylene groups constitute at least 900 molecular weight of the surfactant and the oxyethylene groups constitute 10–90 wt % of the surfactant, or the above formulas in which the ethylene oxide and propylene oxide units are reversed.

15. An aqueous sizing composition comprising from 2 to 20 wt % of the sizing composition of claim 14 in an aqueous medium.

* * * * *